US011486205B2

(12) United States Patent
Lind et al.

(10) Patent No.: US 11,486,205 B2
(45) Date of Patent: Nov. 1, 2022

(54) ROTATING JOINT AND COILED TUBING UNIT

(71) Applicant: NEXUS ENERGY TECHNOLOGIES INC., Red Deer (CA)

(72) Inventors: Orrin Lind, Springbrook (CA); Ryan Smith, Red Deer (CA); Scott Sherman, Blackie (CA)

(73) Assignee: NXL TECHNOLOGIES INC., Red Deer (CA)

( * ) Notice: Subject to any disclaimer, the term of this patent is extended or adjusted under 35 U.S.C. 154(b) by 0 days.

(21) Appl. No.: 17/214,634

(22) Filed: Mar. 26, 2021

(65) Prior Publication Data

US 2021/0310316 A1 Oct. 7, 2021

Related U.S. Application Data

(60) Provisional application No. 63/006,306, filed on Apr. 7, 2020.

(51) Int. Cl.

| | |
|---|---|
| ***E21B 17/02*** | (2006.01) |
| ***E21B 17/04*** | (2006.01) |
| ***E21B 34/16*** | (2006.01) |
| ***E21B 47/12*** | (2012.01) |
| ***H01R 39/10*** | (2006.01) |
| ***H01R 39/14*** | (2006.01) |
| ***H01R 39/41*** | (2006.01) |

(52) U.S. Cl.
CPC ..... *E21B 17/041* (2020.05); *E21B 34/16* (2013.01); *E21B 47/12* (2013.01); *H01R 39/10* (2013.01); *H01R 39/41* (2013.01)

(58) Field of Classification Search
CPC ..... E21B 17/02; E21B 17/04; E21B 17/041; E21B 34/16; E21B 47/12; H01R 39/10; H01R 39/41
See application file for complete search history.

(56) References Cited

U.S. PATENT DOCUMENTS

| | | | | |
|---|---|---|---|---|
| 7,600,564 | B2 * | 10/2009 | Shampine | F16L 27/0828 166/77.2 |
| 8,903,243 | B2 * | 12/2014 | Ullah | E21B 47/135 398/114 |
| 9,156,651 | B2 * | 10/2015 | Park | B65H 75/4481 |
| 10,487,596 | B2 * | 11/2019 | Behrens | E21B 19/22 |
| 10,502,050 | B2 * | 12/2019 | Segura Dominguez | E21B 19/22 |

* cited by examiner

*Primary Examiner* — Matthew R Buck
(74) *Attorney, Agent, or Firm* — Kunzler Bean & Adamson

(57) ABSTRACT

A rotating joint apparatus includes a first section, a second section, and an interface between the first section and the second section. A bearing at the interface is configured such that the first section is rotatable relative to the second section. A main flow passage extends through the first section and the second section. A signal conductor is accessible, by a first connector on an exterior surface of the first section and, and by a second connector on an exterior surface of the second section. The signal conductor includes a signal transmission assembly at the interface.

19 Claims, 5 Drawing Sheets

ROTATING JOINT AND COILED TUBING UNIT

FIELD

This disclosure is directed to a rotating joint such as may be used on a coiled tubing reel. The rotating joint allows for pressurized fluidic communication between the stationary pumping equipment and the rotating reel of coiled tubing.

BACKGROUND

Coiled tubing, according to some conventional designs, includes an uninterrupted length of tubing that is spooled on a reel. The tubing is able to be readily spooled off of the reel and into a wellbore for use in well intervention operations such as plug setting and retrieval, tool conveyance, fishing, and other well service operations that are typically performed with wireline or jointed pipe. Coiled tubing is also often used for well stimulation operations because the bore through the coiled tubing can be used as a fluid passage for stimulation fluids. Alternatively, the annulus between the coiled tubing and the wellbore casing can be used as the fluid passage.

Unlike jointed pipe, coiled tubing can be run into a wellbore while the wellbore is under pressure in a continuous operation. Another benefit of coiled tubing is the continuous bore creates a fluid conduit as well as a passage to run wires and/or fiber optic cables for communication with downhole tools or other purposes, which is not possible with jointed pipe well intervention techniques.

Coiled tubing has become a well-established means for well intervention operations with over a thousand coiled tubing rigs of various sizes and configurations in operation around the world in 2015.

E-Coil is a combination of coiled tubing and an electrical conductor. The electrical conductor may be installed into the coiled tubing. The electrical conductor can include a conventional electric line used in well logging applications or tubing encapsulated cable (TEC) which may include one or more electrical and/or optical conductors encapsulated inside a metallic or composite sheath.

E-Coil allows typical wireline tools and other instruments commonly known to those skilled in the art to be conveyed into wellbores under pressure or along lateral sections of horizontal wells because unlike conventional wireline, coiled tubing can be pushed into a wellbore without relying solely on gravity to pull the tools into a well.

While the reels on coiled tubing units were driven by chains and sprockets, modern coiled tubing units utilize planetary or direct drive reels. Planetary or direct drive reels provide numerous advantages, but limit the available space near the reel.

SUMMARY

In accordance with a broad aspect of the present disclosure, there is provided a rotating joint apparatus, comprising: a first section, extending from a first end to a second end, thereby defining a long axis; a second section coupled to the first section with an interface between the second section and the first section; a bearing at the interface between the first section and the second section, the bearing configured such that the first section is rotatable about the long axis relative to the second section; a main flow passage extending through the first section and the second section along the long axis; and, a signal conductor extending between a first connector accessible on an exterior surface of the first section and a second connector accessible on an exterior surface of the second section, the signal conductor including a signal transmission assembly at the interface, the signal transmission assembly including: a first part on the first section and positioned at the interface in signal transmissive communication with the first connector; and a second part on the second section and positioned at the interface in signal transmissive communication with the second connector and positioned to receive a signal from the first part, while there is rotation between the first part and the second part.

In accordance with another broad aspect of the present disclosure, there is provided a coil tubing unit comprising: a coil tubing reel; high pressure piping connected inside the reel; and a rotating joint apparatus couplable to the high pressure piping, the rotating joint apparatus comprising: a first section including a fluid bore extending from a first end fitting to a second end, thereby defining a long axis through the first bore and the first end coupling configured for coupling to the high pressure piping; a second section coupled to the second section and including a main bore aligned with and in fluid communication with the fluid bore and terminating at a second end coupling; an interface between the first section and the second section where the first section is coupled to the second section; a bearing at the interface between the first section and the second section, the bearing configured such that the first section is rotatable about the long axis relative to the second section; a main flow passage extending through the first section and the second section along the long axis; and, a signal conductor extending between a first connector accessible on an exterior surface of the first section and a second connector accessible on an exterior surface of the second section, the signal conductor including a signal transmission assembly at the interface, the signal transmission assembly including: a first part on the first section and positioned at the interface in signal transmissive communication with the first connector; and a second part on the second section and positioned at the interface in signal transmissive communication with the second connector and positioned to receive a signal from the first part, while there is rotation between the first part and the second part.

In accordance with yet another broad aspect of the present disclosure, there is provided a method for communicating a signal between surface equipment and a coil tubing reel, the method comprising: connecting a rotating joint apparatus as above between the coil tubing reel and the surface equipment, including connecting: (i) a first signal line between the first connector and the coil tubing reel, (ii) fluid piping between the first end of the fluid passage and the coil tubing reel, (iii) a second signal line between the second connector and the surface equipment, and (iv) treating fluid piping between the second end of the fluid passage and the surface equipment; and conducting the signal through the first signal line, the signal conductor of the rotating joint and the second signal line while rotation occurs at the interface between the first section and the second section.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific examples that are illustrated in the appended drawings. Understanding that these drawings depict only typical examples of the subject matter, they are not therefore to be considered to be limiting of its scope. The subject matter will be described and explained with additional specificity and detail through the use of the drawings, in which.

DETAILED DESCRIPTION

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples. Accordingly, the detailed description set forth below in connection with the appended drawings is intended as a description of various embodiments of the present disclosure and is not intended to represent the only embodiments contemplated by the inventor. The detailed description includes specific details for the purpose of providing a comprehensive understanding of the present disclosure. However, it will be apparent to those skilled in the art that the present disclosure may be practiced without these specific details.

This disclosure pertains to a rotating joint for use with a coiled tubing reel that allows for pressurized fluidic communication between the surface equipment such as stationary pumping equipment and the rotating reel of coiled tubing.

While coiled tubing units that utilize planetary or direct drive reels have been adopted recently, they do not work well with E-Coil. The shift toward planetary drive reels has necessitated the development of a solution that allows for E-Coil to be used on modern coiled tubing units.

The rotating joint of the current disclosure is comprised of a mechanical swivel, a high-pressure fluidic coupling, and a signal communication assembly that allows for electrical and/or optical signal communication from the stationary portion of the swivel to the rotating portion of the swivel. Communication of signals through the rotating joint can be used to monitor and/or control equipment within the reel or downhole using E-Coil.

Figure 1:
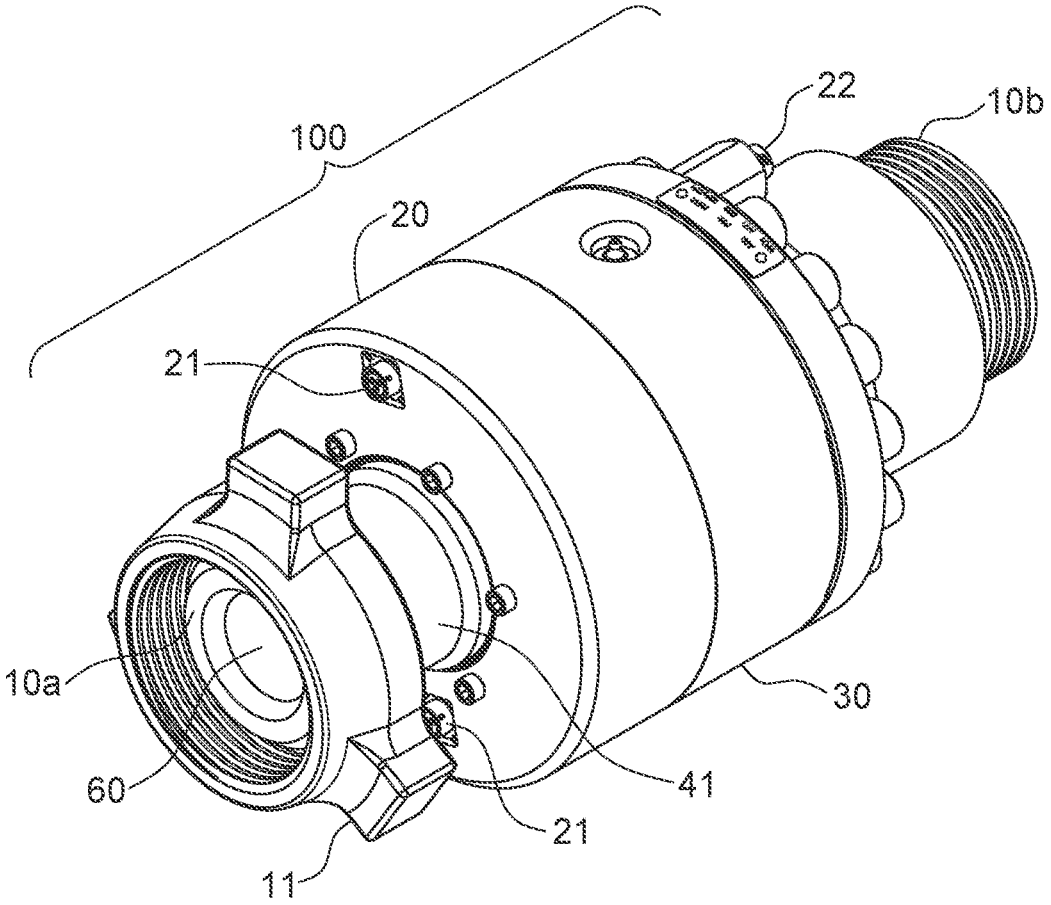
FIG. 1 depicts an isometric view of one embodiment of a rotating joint apparatus of the current disclosure.

One embodiment of a rotating joint is shown as 100 in FIG. 1. Rotating joint includes a first section 20 and a second section 30. These sections are coupled at a rotating connection, which is a swivel-type connection, such that the sections rotate relative to each other about a central axis defined by the length of a fluid passage 60 through the sections.

Hereinafter typical embodiments are described where the first section 20 is a first housing and second section 30 is a bearing housing. While normally in use in a coil tubing unit, bearing housing 30 remains stationary while housing 20 rotates relative thereto about the long axis, it is to be understood that the parts could be reversed so that bearing housing 30 rotates while first housing 20 is maintained stationary.

Returning to the specific embodiment of FIG. 1, the joint includes a rotating first housing 20, a bearing housing 30, signal communication connectors, such as for example in this embodiment, high voltage electrical connectors 21, 22, and fluid tight end connections 10*a*, 10*b* that define the ends of fluid passage 60. A flow tube 41 rotates with the rotating portion, which typically is first housing 20, whereas the bearing housing 30 remains stationary. An outboard end of flow tube 41 defines connection 10*a*. The embodiment 100 shown is rated for continuous pressures up to 15,000 psi and test pressures of 23,625 psi and the bearing section 30 has been developed to be sufficient to react the related hydraulic forces. The load on the bearing from pressure is unidirectional; therefore, the bearing is asymmetrical, larger on one side than the other. The connections 10*a*, 10*b* are rated for high pressures and allow well fluids at high pressure to pass through the fluid passage 60. The end connections 10*a*, 10*b* are illustrated here as threaded with hammer unions 11. However, embodiments alternately may employ flanged high-pressure connections 110*a* (FIG. 7) and the choice of high-pressure connections may vary with the application.

Figure 2:
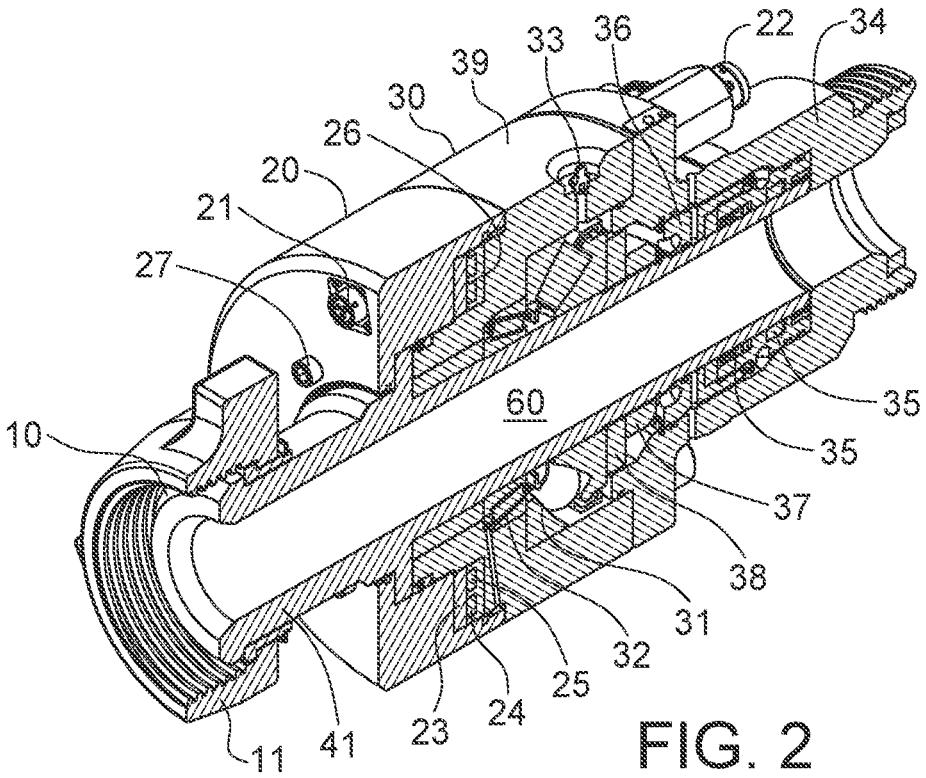
FIG. 2 is an isometric cross section that depicts many of the internal parts of one embodiment of the rotating joint apparatus of the current disclosure.
Figure 6:
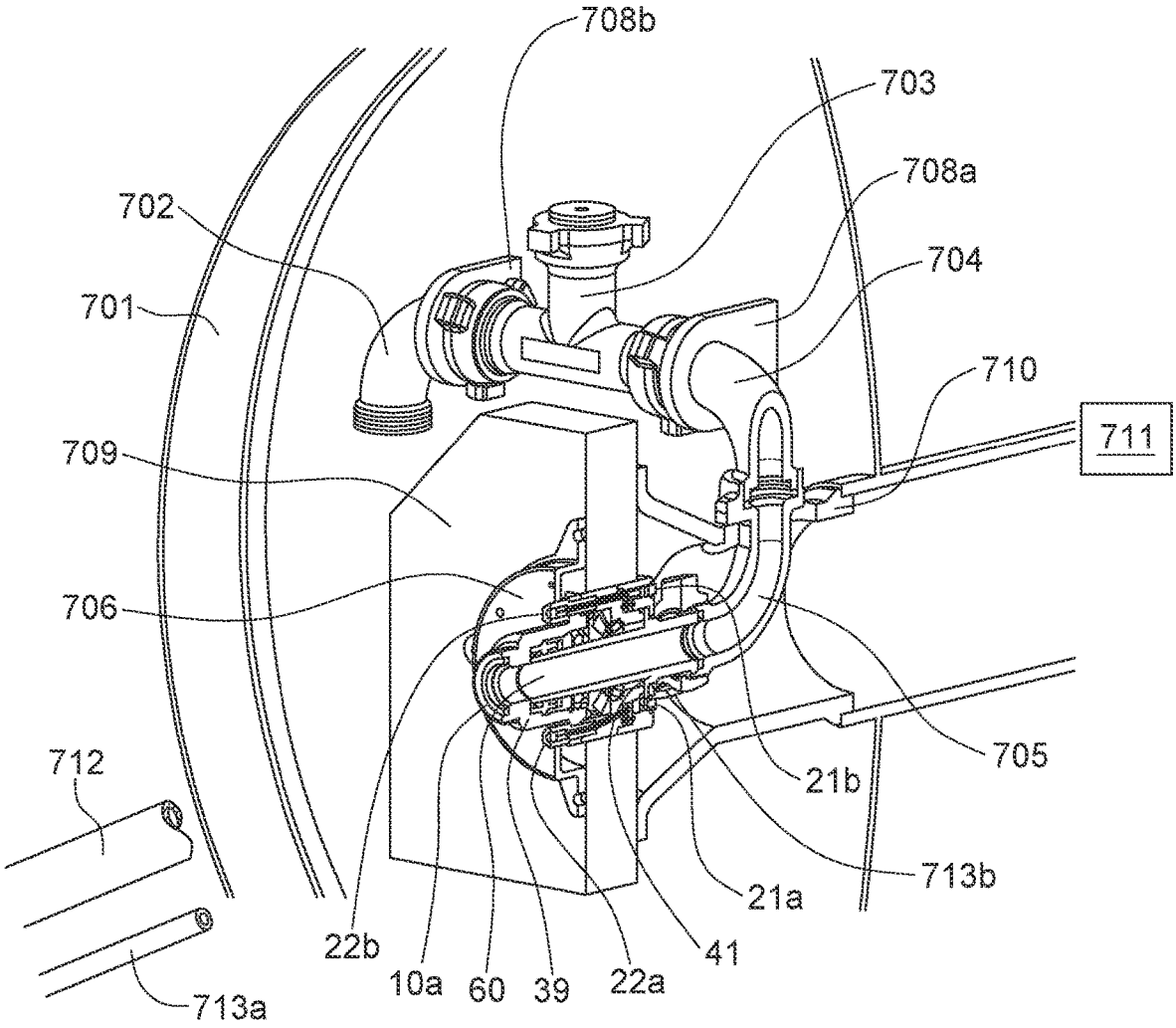
FIG. 6 is a schematic view of a coil tubing reel.

FIG. 2 depicts a cross-sectional view of one embodiment of the subject matter of the present disclosure. A hammer union connection 11 retains the sealing surface 10*a* of the rotating flow tube 41 to the high-pressure lines inside the coiled tubing reel (FIG. 6). The rotating first housing 20 is attached for rotation with the rotating flow tube 41, such as by fasteners 27, splines or other means.

The bearing section 30 includes an end housing 34, a bearing housing 39 containing a radial support bearing 32 and a radial and an axial support bearing 31, a bearing preload nut 38 and a jam nut 37. The end housing and the bearing housing remain rotationally fixed relative to each other, while the first housing 20 rotates relative to these parts. Specifically, in this embodiment, the flow tube 41 rotates within the bearing section. An end of the flow tube 41 is sealed within the end housing 34 using high-pressure seals 35, which are energized by a packing sub 36. The high-pressure well fluid passage 60 is contained within the flow tube 41 and extends through a bore of the stationary housing, specifically in end housing 34, to connection 10*b*. A grease zerk 33 allows the bearings within the bearing housing 39 to be lubricated.

Figure 3:
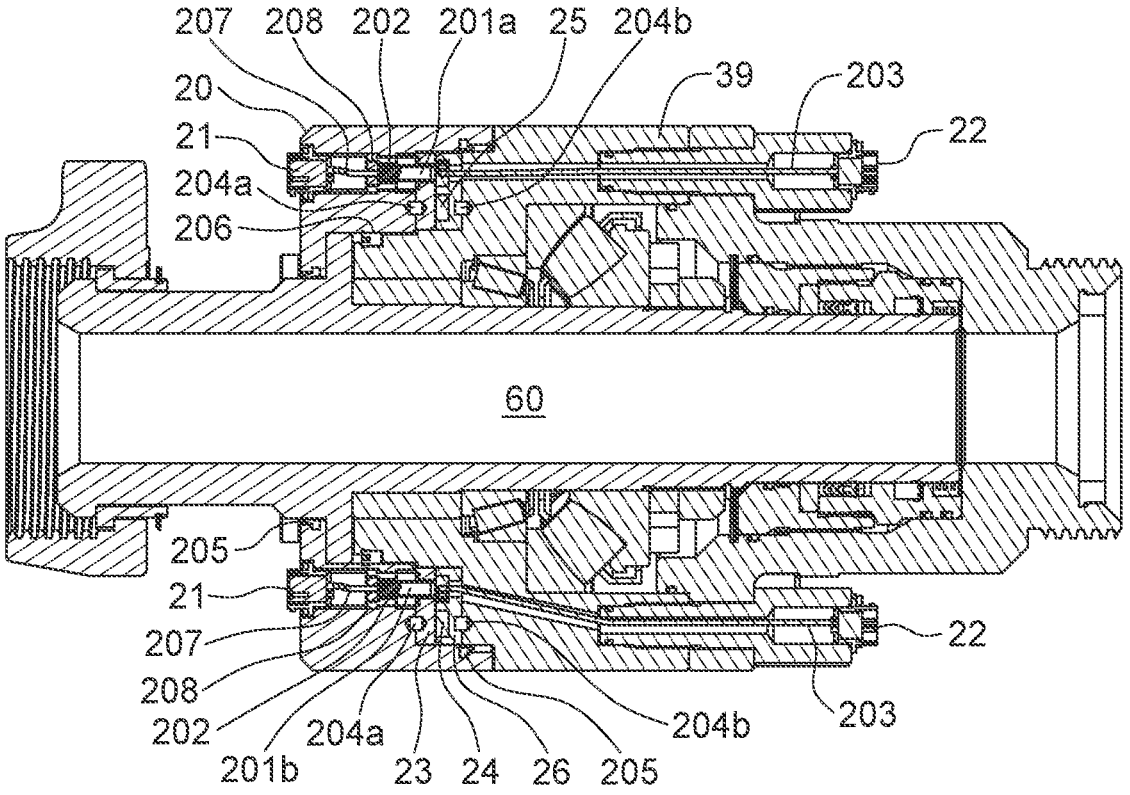
FIG. 3 is a cross section view that depicts the path that electrical signals take through one embodiment of the rotating joint apparatus of the current disclosure.

FIG. 3 is a cross-section depicting the electrical circuitry within an embodiment of the rotating joint. One or more high voltage electrical connectors 21 are exposed on an outer surface of the rotating joint, on rotating first housing 20. These connectors 21 rotate with housing 20. One or more high voltage electrical connectors 22 are exposed on an outer surface of the bearing housing 30.

A signal conductor extends through the rotating joint to provide signal communication between connector 21 and connector 22. The signal conductor includes two portions, one that extends through housing 20 and a second portion that extends through the bearing housing. The first portion and the second portion are in signal transmitting communication at a signal transmission assembly at the interface where rotation occurs between the first housing and the bearing housing. The signal transmission assembly includes a first part on the first housing and a second part on the bearing housing. The first part and the second part are each positioned at the interface in signal transmissive communication with each other, while there is rotation between the first part and the second part. In the illustrated embodiment, the signal transmission assembly includes electrical contacts in the form of an electrical slip ring and a brush that is aligned with the slip ring and rides along it as rotation occurs between them.

In the illustrated embodiment, there are two such signal conductors through the rotating joint. The first housing 20, which rotates, accommodates brushes 201*a*, 201*b* (collectively referred to as brushes 201) protruding through an electrical isolation ring 23. Bearing housing 30 accommodates an inner slip ring 25, an outer slip ring 24, and an electrically isolating slip ring holder 26.

Electrical connectors 21 are electrically connected to brushes 201, for example, using wires 207. The brushes 201*a*, 201*b* are forced into mechanical contact with one or both slip rings 24 and 25 using springs 202. In the illustrated embodiment, some brushes are in contact with inner slip ring 25 and other brushes are in contact with outer slip ring 24. The brushes 201 are slidably mounted within electrically insulating brush holders 208. These holders 208 prevent the brushes 201 from shorting out to the first housing 20. The electrical isolation ring 23 has holes that allow the brushes 201 to protrude through and make contact with the slip rings 24 and 25. Dowel pins 204*a* are used to cause the electrical isolation ring 23 to rotate with the housing 20. The electrically isolating slip ring holder 26 is prevented from rotation by dowel pins 204*b*, which retain it to the bearing housing 39. The inner slip ring 25 and outer slip ring 24 are each electrically connected to one of the high voltage electrical connectors 22 using wires 203. Seals 205 are used to prevent moisture and debris from entering the electrical portion of the rotating joint.

While two electrical separate paths (i.e. one through ring 24/brush 201*a* and another through ring 25/brush 201*b*) are shown and described, there may be only one electrical path or more than two electrical paths. The configuration and number of conductive paths may be selected based on preferences, of course with consideration to complexity and size limitations.

For example, there may be one electrical path through the tool, either through one brush ring interface or where there is some connectivity between all the brushes and rings.

The embodiment as shown, however, with two separate conductive paths is useful as it permits one or more modes of operation such as: one path can conduct a positive signal, while the other conducts a negative signal; or one can be for power transmission, while the other is for data transmission; or one can be for ground and the other for signal/power, etc. The conductive apparatus of brushes and rings may be the same material/construction, in redundancy or they may differ depending on the type of signal to be transmitted. For example, the first ring and its brush may be identical in construction and material to the second ring and brush or there may be differences between the two conducting paths. For example, the ring and/or brush for power transmission may take a different form than the ring and brush for data transmission.

While the signal communication components including connections 21, slip rings 24, 25, brushes 201 are illustrated for electrical signal communications, it is to be understood that these components can be selected to accommodate the signal to be transmitted. For example, optical signals can be sent through the rotating joint in the same manner as depicted with the electrical slip rings and brushes. A rotary optical transmitter uses fiber optic connectors instead of connectors 21, 22 and fiber optic cable instead of wires 203, 207. The slip rings 24, 25 are replaced by optically transmissive rings. The isolation components, such as ring 23, are selected to prevent light transmission as opposed to preventing electricity transmission.

For high frequency data transmission, in some cases it is desirable to contact the slip ring at multiple points such as for example having multiple brushes in contact with each slip ring. This has several benefits including reducing the net contact resistance between the brushes and the slip rings, and smoothing out attenuation in the signals as the brushes travel along the contact surfaces of the slip rings.

In the case of electric signal transmission, the brushes may be made of graphite and/or copper and the slip rings can include at least in part copper, brass, nickel, silver, gold or some combination thereof. In one embodiment, brass slip rings are coated with a noble metal alloy containing one or more of the following constituents; nickel, silver, or gold. A coating containing a noble metal is useful to avoid an electrically resistive oxide layer from forming on the slip rings on the contact path of the brushes. In one embodiment, a nickel coating is employed on a brass ring. Considering a typical example of operation: 2 ohms of contact resistance at 1000 v results in 2 kW of ohmic heating at the brush/slip ring interface. Oxidation on the brush/ring interface can lead and even higher resistance. A slight tarnish on the ring resulting from 6 months atmospheric exposure increased the resistance to about 3 ohm such that when 1000 v was applied, it resulted in 3 kW of ohmic heating at the brush/slip ring contact.

Figure 4:
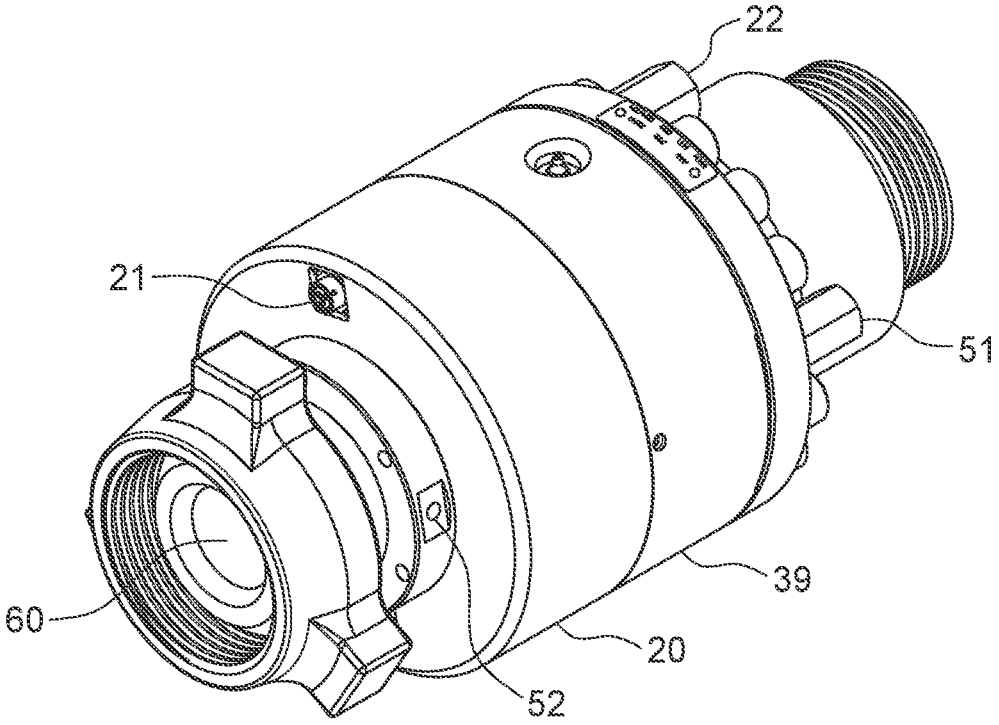
FIG. 4 depicts an isometric view of another embodiment of the rotating joint apparatus of the disclosure, which incorporates hydraulic passages in addition to electrical transmission features.
Figure 5:
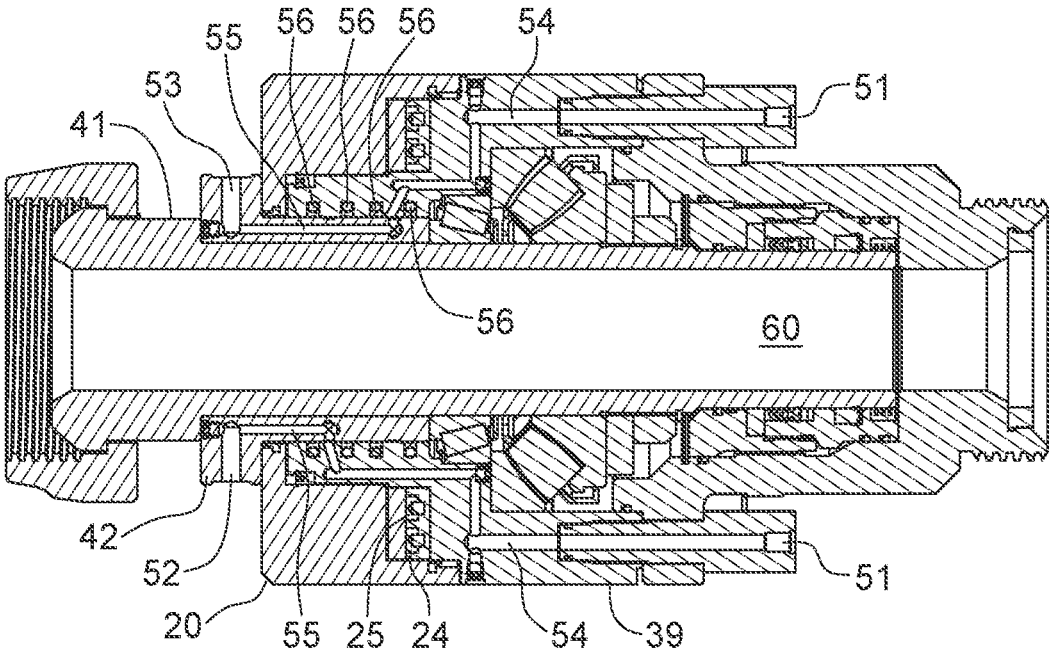
FIG. 5 is a cross section view that depicts the path that hydraulic fluid or compressed gas would take through one embodiment of the rotating joint apparatus of the current disclosure.

FIGS. 4 and 5 depict yet another embodiment of the current disclosure. This embodiment can also be configured for signal transmission, but has at least fluid passages for fluid communication through the rotating joint. In particular, this embodiment has one or more fluid passageways separate from, and in addition to, the main passageway 60. These passageways allow fluids, such as for example hydraulic fluids or compressed gasses, to flow through the swivel while it is rotating.

As with the embodiments of FIGS. 1 to 3, the first housing 20 rotates about a long axis of flow passage 60 relative to bearing housing 30 and high voltage electrical connectors 21 are electrically connected through the swiveling interface to high voltage electrical connectors 22.

In addition, the embodiment of FIGS. 4 and 5 includes hydraulic ports 52 and 51 that are respectively on the rotating, first housing 20 and on the stationary bearing housing 39. Similarly, to the connectors 21, 22, hydraulic ports 52 are hydraulically connected through the swivel to hydraulic ports 51. These ports 51, 52 and the passages between them are fluid isolated from the larger diameter high-pressure well treatment fluid passage 60 that passes through the center axis of the assembly.

In this embodiment, the rotating flow tube 41 is attached for rotation with a hydraulic bushing 42. The rotating hydraulic bushing 42 has hydraulic ports 52 and hydraulic passages 55. Stationary hydraulic ports 51 on bearing housing 39 are hydraulically connected to hydraulic passages 54 that extend through housing 39. Hydraulic passages 55 from ports 52 and 53 are hydraulically connected to hydraulic passages 54 in the bearing housing 39, which is stationary. An annular gland, for example, at inner end of passage 55 permits continuous communication between passages 54, 55, even while relative rotation occurs between them. Seals 56 prevent leaks from the passages, for example, into the bearing section. While all passages 54 could be in fluid communication with all passages 55, it is noted that in this embodiment, there is provision for two independent hydraulic connections. In particular, a further port 53 on rotating housing 20 opens to a separate passage 55 that terminates at a position axially offset from the terminal end of the passage 55 from port 52. Seals 56 can also fluidly isolate these passages from each other at the swivel interface.

This embodiment also has the signal communication apparatus including slip rings 24 and 25, brushes, etc. and so is capable of both electric and hydraulic transmission. The high-pressure well treatment fluid passage 60 in flow tube 41 passes through the center axis of the assembly.

Figure 7:
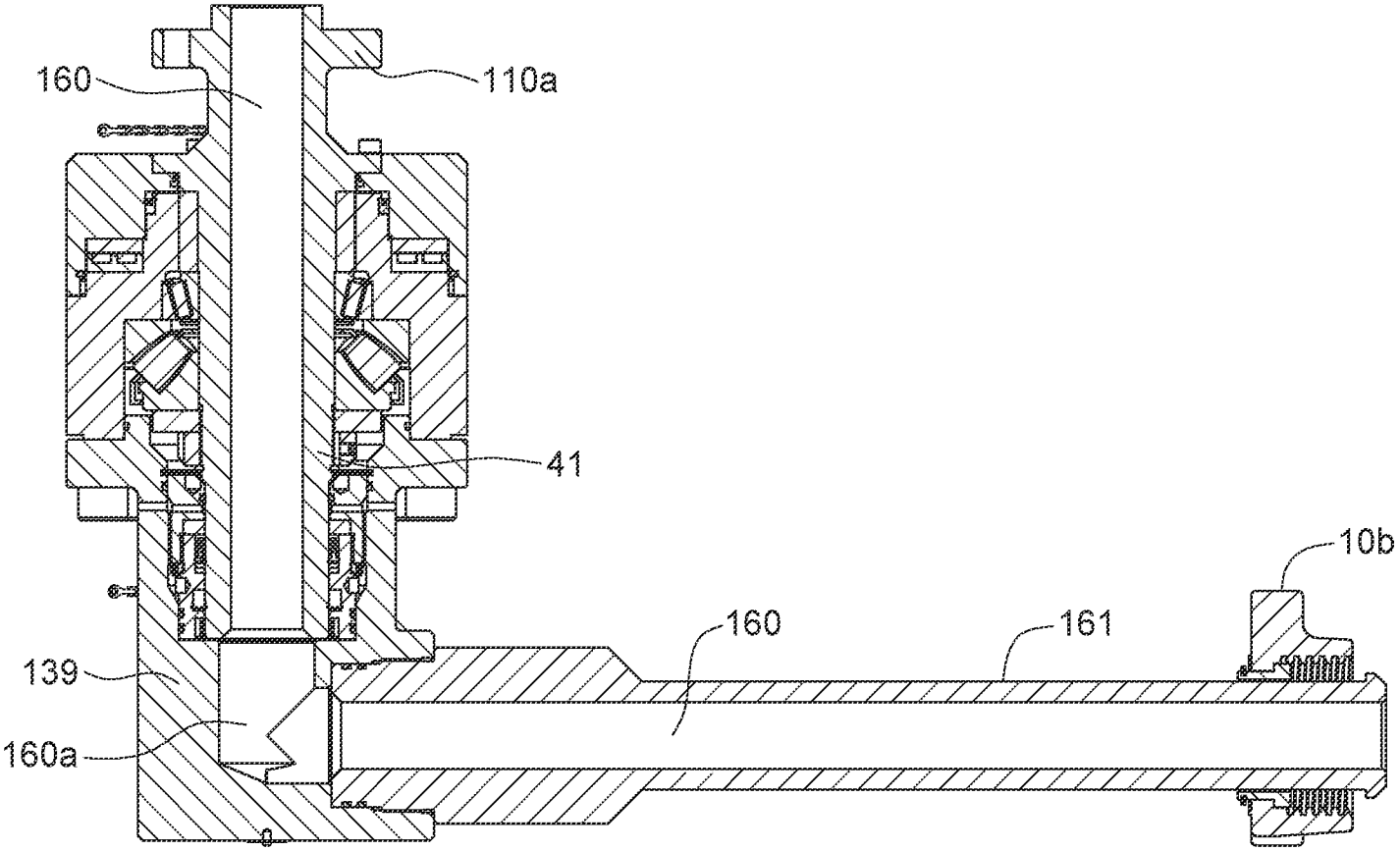
FIG. 7 is a sectional view of another embodiment of the rotating joint apparatus of the current disclosure.

FIG. 7 shows another embodiment of the disclosure, wherein the main fluid passage is non-linear. In particular, main fluid passage 160 in FIG. 7 includes an elbow, instead of being linear from end to end, as shown by passages 60 in FIGS. 1 to 5. While flow tube 41 is linear, in the embodiment of FIG. 7, the portion 160*a* of the fluid passage 160 that extends through bearing housing 139, is non-linear, between the end of the flow tube 41 and connection 10*b*. In particular, end housing 134 of bearing housing 139 has a bore coaxially aligned with flow tube 41 that includes an elbow therein and a pipe 161 extending from the end housing that terminates in connection 10*b*. While main flow passage 160 is illustrated with an approximately 90° ell therein, other angles are possible. Although they cannot be seen in FIG. 7, the operation of signal communication between connectors 21, 22, such as in FIG. 2, across the swiveling interface is consistent with the other embodiments.

The drawings depict a simple embodiment of the disclosure for the purposes of illustration and brevity. While description of the components have been simplified in described, it will be apparent, that parts such as for example first housing 20 or bearing housing 39 can be complex and constructed of a number of interconnected subcomponents, seals, etc.

In use, the rotating joint is connected between the treating piping on the stationary side and internal, high-pressure piping, inside the coil tubing reel on the rotating side. As such, bearing housing 39 is stationary while the first housing 20 rotates relative to bearing housing 39 along a long axis defined concentric to tube 41. Connection 11 retains the sealing surface 10*a* of the rotating flow tube 41 to the high-pressure lines inside the coiled tubing reel. Electrical signal cables are connected to the assembly with high voltage electrical connectors 21 and 22. The high voltage electrical connectors 21 are electrically connected through the slip rings and brushes to high voltage electrical connectors 22, while the bearings permit rotation between the sections 20, 30 at the interface between them. At the same time, well fluids can be pumped through passage 60 extending between ends 10*a*, 10*b* through tube 41. In typical applications, the one or more electrical communication paths may involve voltages ranging from approximately 3,500 V to approximately −3,500 V, alternating current or direct current and currents ranging from approximately 0 to approximately 2r0 A and the fluid pressure in passage 60 may range between approximately 1,000 and approximately 25,000 psi.

FIG. 6 depicts a partial cross section of one embodiment of the current disclosure installed into a coiled tubing reel 701. The rotating joint is installed so that the flow tube 41 is mounted coaxially with the hub 710 of the reel 701. The rotating joint is mounted to the mounting plate 706, which is attached to the reel support 709, at a side of the reel. The inner passage 60 of the flow tube 41 is fluidly connected to a high-pressure ell 705, which is in turn fluidly connected to another high-pressure ell 704, a high-pressure tee with a valve 703, and another high-pressure ell that is fluidly connected to the inner wrap of the coiled tubing (not shown). The high-pressure tee 703 is further attached to the reel with supplementary supports 708*a* and 708*b*. In the configuration of this embodiment of the disclosure shown, the reel support 709, the bearing housing 39 with connection 10*a*, electrical connectors 22*a* and 22*b*, and the mounting plate 706 do not rotate, whereas the reel 701, the flow tube 41, the electrical connections 21*a* and 21*b*, the high pressure piping, sometimes called iron, encompassed by the ells 705, 704, 702, and tee 703 do rotate, as driven by drive 711, as the coiled tubing is run into and out of a wellbore.

As noted, rotating joint 100 is connected to end fittings of the high-pressure lines and rotating joint 100 is, thereby, coupled at a side of the reel. A fluid pipe 712 is connected at end 10*a*. Signal cables 713*a*, 713*b* are coupled to the rotating joint and thereby to the reel and its components at high voltage electrical connectors 21 and 22.

In some embodiments, the reel's drive 711 is a direct or planetary drive for rotation thereof.

The signal communication configuration, be it electrical, optical or otherwise, may be used for data communication such as for communication of signals to or from downhole tools through the E-coil. Alternately, or in addition, the signals may be used to control mechanisms of a coiled tubing unit, such as flow control valves within the reel.

For the embodiment of FIGS. 4 and 5, the hydraulic lines are connected to the rotating joint at ports 51, 52, 53. The hydraulic communications through the rotating joint may be for controlling hydraulic devices within the reel.

Some examples of the subject matter of the present disclosures are provided in the following clauses.

Clause 1. A rotating joint apparatus, comprising:

a first section, extending from a first end to a second end, thereby defining a long axis;

a second section coupled to the first section with an interface between the second section and the first section;

a bearing at the interface between the first section and the second section, the bearing configured such that the first section is rotatable about the long axis relative to the second section;

a main flow passage extending through the first section and the second section along the long axis; and, a signal conductor extending between a first connector accessible on an exterior surface of the first section and a second connector accessible on an exterior surface of the second section, the signal conductor including a signal transmission assembly at the interface, the signal transmission assembly including:

a first part on the first section and positioned at the interface in signal transmissive communication with the first connector; and a second part on the second section and positioned at the interface in signal transmissive communication with the second connector and positioned to receive a signal from the first part, while there is rotation between the first part and the second part.

Clause 2. The apparatus of any one or more of clauses 1-33, further comprising: a flow tube extending from, and fixed for rotation with, the first section, the long axis being defined concentrically within the flow tube; and at least a portion of the second section being sleeved around the flow tube proximate the second end, wherein the main flow passage extends within the flow tube.

Clause 3. The apparatus of any one or more of clauses 1-33, wherein the signal conductor is configured to transmit an electrical signal and the first part and the second part are a pair of electrical contacts and further comprising a biasing member to maintain contact between the pair of electrical contacts as a first of the pair of electrical contacts rotates relative to a second one of the pair of electrical contacts.

Clause 4. The apparatus of any one or more of clauses 1-33, wherein the pair of electrical contacts includes (i) a slip ring encircling the long axis and (ii) a brush being urged by a spring toward and into contact with the slip ring.

Clause 5. The apparatus of any one or more of clauses 1-33, wherein the interface includes a first annular surface on the first section encircling the main flow passage and a second annular surface on the second section encircling the main flow passage, the first annular surface facing the second annular surface and wherein the second part is a slip ring installed concentrically on the second annular surface and the first part is a signal conductive brush biased out from the first annular surface into contact with the slip ring.

Clause 6. The apparatus of any one or more of clauses 1-33, further comprising a brush holder, positioned axially around the brush, for isolating the brush from electrical signals other than those exchanged with one or both of the first connector and the slip ring.

Clause 7. The apparatus of any one or more of clauses 1-33, further comprising a ring holder positioned radially around the ring, with one or more portions of the ring exposed to allow communication with the brush and second connector, for isolating the slip ring from electrical signals other than those exchanged with one or both of the brush and second connector.

Clause 8. The apparatus of any one or more of clauses 1-33, further comprising a second signal conductor extending between a third connector accessible on an exterior surface of the first section and a fourth connector accessible on an exterior surface of the second section, the second signal conductor including a second signal transmission assembly at the interface.

Clause 9. The apparatus of any one or more of clauses 1-33, wherein the signal conductor is configured to transmit an optical signal and the first part and the second part are a pair of optically transmissive contacts.

Clause 10. The apparatus of any one or more of clauses 1-33, further comprising:

a fluid transmission passage including an annular gland at the interface, the annular gland encircling, but fluidly isolated from, the fluid passageway; a first fluid port extending from the exterior surface of the first section to the annular gland; and a second fluid port extending from the exterior surface of the second section to the annular gland.

Clause 11. A coil tubing unit comprising:

a coil tubing reel;

high pressure piping connected inside the reel; and a rotating joint apparatus couplable to the high pressure piping, the rotating joint apparatus comprising:

a first section including a fluid bore extending from a first end fitting to a second end, thereby defining a long axis through the first bore and the first end coupling configured for coupling to the high pressure piping;

a second section coupled to the second section and including a main bore aligned with and in fluid communication with the fluid bore and terminating at a second end coupling;

an interface between the first section and the second section where the first section is coupled to the second section;

a bearing at the interface between the first section and the second section, the bearing configured such that the first section is rotatable about the long axis relative to the second section;

a main flow passage extending through the first section and the second section along the long axis; and, a signal conductor extending between a first connector accessible on an exterior surface of the first section and a second connector accessible on an exterior surface of the second section, the signal conductor including a signal transmission assembly at the interface, the signal transmission assembly including:

a first part on the first section and positioned at the interface in signal transmissive communication with the first connector; and a second part on the second section and positioned at the interface in signal transmissive communication with the second connector and positioned to receive a signal from the first part, while there is rotation between the first part and the second part.

Clause 12. The apparatus of any one or more of clauses 1-33, wherein the main flow passage accommodates pressures in the range of 950 psi to 25,500 psi.

Clause 13. The apparatus of any one or more of clauses 1-33, wherein the electrical signal has a voltage in the range of −3,500 V to 3,500 V, of alternating current or direct current.

Clause 14. The apparatus of any one or more of clauses 1-33, wherein the electrical signal has an amperage in the range of 0 A to 25 A.

Clause 15. The apparatus of any one or more of clauses 1-33, wherein the signal conductor is configured to transmit data.

Clause 16. The apparatus of any one or more of clauses 1-33, wherein the signal conductor is configured to communicate signals to or from one or more downhole tools.

Clause 17. The apparatus of any one or more of clauses 1-33, wherein the fluid transmission passage, the first fluid port, and the second fluid port are configured to permit hydraulic communication for controlling one or more hydraulic devices of the coil tubing reel.

Clause 18. The apparatus of any one or more of clauses 1-33, wherein the brush is made at least partly of one or more of copper and graphite.

Clause 19. The apparatus of any one or more of clauses 1-33, wherein the slip ring is made at least partly of one or more of copper, brass, nickel, gold, and silver.

Clause 20. The apparatus of any one or more of clauses 1-33, further comprising a plurality of slip rings and a plurality of brushes.

Clause 21. The apparatus of any one or more of clauses 1-33, wherein the main flow passage accommodates pressures in the range of 900 psi to 25,500 psi.

Clause 22. The apparatus of any one or more of clauses 1-33, wherein one or both of the signal conductor and the second signal conductor are configured to transmit an electrical signal, the electrical signal having a voltage in the range of −3,500 V to 3,500 V, of alternating current or direct current.

Clause 23. The apparatus of any one or more of clauses 1-33, wherein one or both of the signal conductor and the second signal conductor are configured to transmit an electrical signal, the electrical signal having an amperage in the range of 0 to 2r0 A.

Clause 24. The apparatus of any one or more of clauses 1-33, wherein one or both of the signal conductor and the second signal conductor are configured to transmit data.

Clause 25. The apparatus of any one or more of clauses 1-33, wherein one or both of the signal conductor and the second signal conductor are configured to communicate signals to or from one or more downhole tools.

Clause 26. The apparatus of any one or more of clauses 1-33, wherein one or both of the signal conductor and the second signal conductor are configured to transmit an optical signal, the first part and the second part of the signal conductor, second signal conductor, or both being optically transmissive contacts.

Clause 27. The apparatus of any one or more of clauses 1-33, wherein the coil tubing reel includes one or more of a direct drive or a planetary drive, for rotating the coil tubing reel.

Clause 28. The apparatus of any one or more of clauses 1-33, wherein the coil tubing reel includes one or more flow control valves; and the signal conductor is configured to control at least one of the one or more flow control valves.

Clause 29. A method for communicating a signal between surface equipment and a coil tubing reel, the method comprising:

connecting a rotating joint apparatus according to any one of claims 1 to 10 between the coil tubing reel and the surface equipment, including connecting: (i) a first signal line between the first connector and the coil tubing reel, (ii) fluid piping between the first end of the fluid passage and the coil tubing reel, (iii) a second signal line between the second connector and the surface equipment, and (ii) treating fluid piping between the second end of the fluid passage and the surface equipment; and conducting the signal through the first signal line, the signal conductor of the rotating joint and the second signal line while rotation occurs at the interface between the first section and the second section.

Clause 30. The method of any one or more of clauses 1-33, further comprising regulating flow through the coil tubing by communicating the signal to a flow control valve of the coil tubing reel.

Clause 31. The method of any one or more of clauses 1-33, further comprising controlling one or more downhole tools by communicating the signal to the one or more downhole tools.

Clause 32. The method of any one or more of clauses 1-33, further comprising controlling one or more hydraulic devices of the coil tubing reel by hydraulic communication through the first end, the fluid passage, and the second end.

Clause 33. The method of any one or more of clauses 1-33, further comprising rotating the coil tubing reel using one or more of a direct drive and a planetary drive.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." Moreover, unless otherwise noted, as defined herein a plurality of particular features does not necessarily mean every particular feature of an entire set or class of the particular features.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A rotating joint apparatus, comprising:

a first section, extending from a first end to a second end, thereby defining a long axis;

a second section coupled to the first section with an interface between the second section and the first section;

a bearing at the interface between the first section and the second section, the bearing configured such that the first section is rotatable about the long axis relative to the second section;

a main flow passage extending through the first section and the second section along the long axis; and, a signal conductor extending between a first connector accessible on an exterior surface of the first section and a second connector accessible on an exterior surface of the second section, the signal conductor including a signal transmission assembly at the interface, the signal transmission assembly including:

a first part on the first section and positioned at the interface in signal transmissive communication with the first connector; and a second part on the second section and positioned at the interface in signal transmissive communication with the second connector and positioned to receive a signal from the first part, while there is rotation between the first part and the second part.

2. The apparatus of claim 1, further comprising:

a flow tube extending from, and fixed for rotation with, the first section, the long axis being defined concentrically within the flow tube; and at least a portion of the second section being sleeved around the flow tube proximate the second end, wherein the main flow passage extends within the flow tube.

3. The apparatus of claim 1, wherein the signal conductor is configured to transmit an electrical signal and the first part and the second part are a pair of electrical contacts and further comprising a biasing member to maintain contact between the pair of electrical contacts as a first of the pair of electrical contacts rotates relative to a second one of the pair of electrical contacts.

4. The apparatus of claim 3 wherein the pair of electrical contacts includes (i) a slip ring encircling the long axis and (ii) a brush being urged by a spring toward and into contact with the slip ring.

5. The apparatus of claim 1, wherein the interface includes a first annular surface on the first section encircling the main flow passage and a second annular surface on the second section encircling the main flow passage, the first annular surface facing the second annular surface and wherein the second part is a slip ring installed concentrically on the second annular surface and the first part is a signal conductive brush biased out from the first annular surface into contact with the slip ring.

6. The apparatus of claim 5, further comprising:

a brush holder, positioned axially around the brush, for isolating the brush from electrical signals other than those exchanged with one or both of the first connector and the slip ring; and a ring holder positioned radially around the ring, with one or more portions of the ring exposed to allow communication with the brush and the second connector, for isolating the slip ring from electrical signals other than those exchanged with one or both of the brush and the second connector.

7. The apparatus of claim 1, further comprising a second signal conductor extending between a third connector accessible on an exterior surface of the first section and a fourth connector accessible on an exterior surface of the second section, the second signal conductor including a second signal transmission assembly at the interface.

8. The apparatus of claim 1, wherein the signal conductor is configured to transmit an optical signal and the first part and the second part are a pair of optically transmissive contacts.

9. The apparatus of claim 1, further comprising:

a fluid transmission passage including an annular gland at the interface, the annular gland encircling, but fluidly isolated from, the fluid passageway;

a first fluid port extending from the exterior surface of the first section to the annular gland; and a second fluid port extending from the exterior surface of the second section to the annular gland.

10. The apparatus of claim 1, wherein the main flow passage accommodates pressures in the range of 950 psi to 25,500 psi.

11. The apparatus of claim 3, wherein the electrical signal has a voltage in the range of −3,500 V to 3,500 V, of alternating current or direct current and wherein the electrical signal has an amperage in the range of 0 A to 25 A.

12. The apparatus of claim 4, wherein the brush is made at least partly of one or more of copper and graphite and wherein the slip ring is made at least partly of one or more of copper, brass, nickel, gold, and silver.

13. A coil tubing unit comprising:

a coil tubing reel;

high pressure piping connected inside the reel; and a rotating joint apparatus couplable to the high pressure piping, the rotating joint apparatus comprising:

a first section including a fluid bore extending from a first end coupling to a second end, thereby defining a long axis through the first bore and the first end coupling configured for coupling to the high pressure piping;

a second section coupled to the second section and including a main bore aligned with and in fluid communication with the fluid bore and terminating at a second end coupling;

an interface between the first section and the second section where the first section is coupled to the second section;

a bearing at the interface between the first section and the second section, the bearing configured such that the first section is rotatable about the long axis relative to the second section;

a main flow passage extending through the first section and the second section along the long axis; and, a signal conductor extending between a first connector accessible on an exterior surface of the first section and a second connector accessible on an exterior surface of the second section, the signal conductor including a signal transmission assembly at the interface, the signal transmission assembly including:

a first part on the first section and positioned at the interface in signal transmissive communication with the first connector; and a second part on the second section and positioned at the interface in signal transmissive communication with the second connector and positioned to receive a signal from the first part, while there is rotation between the first part and the second part.

14. The coil tubing unit of claim 13, wherein the coil tubing reel includes one or more of a direct drive or a planetary drive, for rotating the coil tubing reel.

15. The coil tubing unit of claim 13, wherein the coil tubing reel includes one or more flow control valves; and the signal conductor is configured to control at least one of the one or more flow control valves.

16. A method for communicating a signal between surface equipment and a coil tubing reel, the method comprising:

connecting a rotating joint apparatus according to claim 1 between the coil tubing reel and the surface equipment, including connecting: (i) a first signal line between the first connector and the coil tubing reel, (ii) fluid piping between the first end of the fluid passage and the coil tubing reel, (iii) a second signal line between the second connector and the surface equipment, and (iv) treating fluid piping between the second end of the fluid passage and the surface equipment; and conducting the signal through the first signal line, the signal conductor of the rotating joint and the second signal line while rotation occurs at the interface between the first section and the second section.

17. The method of claim 16, further comprising regulating flow through a coil tubing by communicating the signal to a flow control valve of the coil tubing reel.

18. The method of claim 16, further comprising controlling one or more downhole tools by communicating the signal to the one or more downhole tools.

19. The method of claim 16, further comprising controlling one or more hydraulic devices of the coil tubing reel by hydraulic communication through the first end, the fluid passage, and the second end.

* * * * *